US011124350B2

(12) United States Patent
Schiltz et al.

(10) Patent No.: US 11,124,350 B2
(45) Date of Patent: Sep. 21, 2021

(54) CONTAINER CONFIGURED TO COLLECT AND RETAIN FLUID SHED FROM CONTAINER CONTENTS

(71) Applicant: Advan Packaging Systems, LLC, Columbia, SC (US)

(72) Inventors: David C. Schiltz, Columbia, SC (US); Kenneth J. VanderVelde, Chicago, IL (US)

(73) Assignee: Advan Packaging Systems LLC, Columbia, SC (US)

( * ) Notice: Subject to any disclaimer, the term of this patent is extended or adjusted under 35 U.S.C. 154(b) by 0 days.

(21) Appl. No.: 16/666,673

(22) Filed: Oct. 29, 2019

(65) Prior Publication Data

US 2020/0180842 A1 Jun. 11, 2020

Related U.S. Application Data

(60) Provisional application No. 62/757,341, filed on Nov. 8, 2018.

(51) Int. Cl.

*B65D 81/26* (2006.01)
*B65D 1/22* (2006.01)
*B65D 1/40* (2006.01)

(52) U.S. Cl.

CPC ..... *B65D 81/262* (2013.01); *B65D 1/22* (2013.01); *B65D 1/40* (2013.01); *B65D 2301/20* (2013.01)

(58) Field of Classification Search

CPC ..... B65D 81/262; B65D 1/22; B65D 1/40; B65D 81/264; B65D 1/34; B65D 81/265; B31B 2120/40; Y10T 428/1376; Y10T 428/24744

USPC ..... 229/407, 120, 122.32, 119, 122.34; 426/129; 206/204; 264/177.1

See application file for complete search history.

(56) References Cited

U.S. PATENT DOCUMENTS

| | | | | | |
|---|---|---|---|---|---|
| 2,164,025 | A | * | 6/1939 | Schwertfeger | B65D 81/24 426/124 |
| 2,358,943 | A | | 9/1944 | Smith | |
| 3,097,781 | A | | 7/1963 | Masi | |
| 3,156,402 | A | * | 11/1964 | Dupuis | B65D 81/264 206/204 |
| 3,201,026 | A | | 8/1965 | Travis et al. | |
| 3,660,116 | A | | 5/1972 | Clark | |
| 3,704,142 | A | * | 11/1972 | Wilson | A47J 37/108 99/446 |
| 3,863,829 | A | | 2/1975 | Merrill | |
| 3,881,648 | A | | 5/1975 | Hall | |

(Continued)

*Primary Examiner* — Christopher R Demeree
(74) *Attorney, Agent, or Firm* — Additon, Pendleton & Witherspoon, P.A.

(57) ABSTRACT

A container configured for at least partially containing fresh meat can include a base panel above which an interior space of the container is defined. The base panel can be configured to support fresh meat, and elongate interior passageways can be at least partially defined by the base panel. Openings can be respectively open to the plurality of interior passageways for allowing fluid from the fresh meat in the interior space of the container to flow into the interior passageways. The container can be configured to at least partially retain the fluid in the interior passageways, including opposite end sections of at least some of the interior passageways being closed to at least partially define compartments for receiving and retaining the fluid.

20 Claims, 7 Drawing Sheets

(56) References Cited

U.S. PATENT DOCUMENTS

| | | | | |
|---|---|---|---|---|
| 4,265,390 | A | 5/1981 | Faller et al. | |
| 5,145,067 | A | 9/1992 | Carver | |
| 5,163,609 | A | 11/1992 | Muise, Jr. | |
| 5,263,612 | A | 11/1993 | Nederveld | |
| 5,390,847 | A | 2/1995 | Young | |
| 5,458,283 | A | 10/1995 | Southwell et al. | |
| 5,462,220 | A | 10/1995 | Bacchetti et al. | |
| 5,503,324 | A | 4/1996 | Bacchetti et al. | |
| 5,518,171 | A | 5/1996 | Moss | |
| 5,642,854 | A | 7/1997 | Hatton | |
| 5,658,644 | A | 8/1997 | Ho et al. | |
| 5,967,662 | A | 10/1999 | Chew | |
| 5,979,655 | A | 11/1999 | Tseng et al. | |
| 6,079,877 | A | 6/2000 | Chew | |
| 6,102,279 | A | 8/2000 | Dowd | |
| 6,382,429 | B1 | 5/2002 | Yeh et al. | |
| 6,481,594 | B1 | 11/2002 | Yeh et al. | |
| 6,695,138 | B1 * | 2/2004 | Colombo | B65D 77/003 206/204 |
| 6,759,114 | B2 | 7/2004 | Wu et al. | |
| 6,938,818 | B2 | 9/2005 | Moorman et al. | |
| 8,668,132 | B2 | 3/2014 | Lopez Masague | |
| 8,784,959 | B2 | 7/2014 | O'Hagan et al. | |
| 8,998,072 | B2 | 4/2015 | Whittles et al. | |
| 9,028,636 | B2 | 5/2015 | Frigge et al. | |
| 9,290,290 | B2 | 3/2016 | Carman | |
| 9,321,550 | B2 | 4/2016 | Whittles et al. | |
| 9,434,123 | B2 | 9/2016 | Carman | |
| 9,527,622 | B2 | 12/2016 | Carman | |
| D812,468 | S | 3/2018 | Carman | |
| 10,207,848 | B2 | 2/2019 | Alexander et al. | |
| 10,220,975 | B2 | 3/2019 | Carman | |
| 10,399,734 | B2 * | 9/2019 | Dalgleish | B65D 5/64 |
| 2004/0222542 | A1 | 11/2004 | Jan et al. | |
| 2006/0026349 | A1 | 11/2006 | Whittles | |
| 2008/0003869 | A1 | 1/2008 | Wu et al. | |
| 2008/0003870 | A1 | 1/2008 | Wu et al. | |
| 2008/0017596 | A1 | 7/2008 | Whittles et al. | |
| 2008/0175961 | A1 | 7/2008 | Whittles et al. | |
| 2011/0036904 | A1 | 2/2011 | Lopez Masague | |
| 2012/0193365 | A1 * | 8/2012 | Humphries | B65D 5/244 220/592.2 |
| 2015/0251797 | A1 | 9/2015 | Carman | |
| 2015/0329236 | A1 | 11/2015 | Deering et al. | |
| 2016/0075465 | A1 | 3/2016 | Wiley | |
| 2016/0137333 | A1 | 5/2016 | Brundage | |
| 2017/0101212 | A1 | 4/2017 | Carman | |
| 2018/0009564 | A1 | 1/2018 | Carman | |

* cited by examiner

CONTAINER CONFIGURED TO COLLECT AND RETAIN FLUID SHED FROM CONTAINER CONTENTS

CROSS-REFERENCE TO PRIORITY APPLICATION

This application claims the benefit of U.S. Provisional Patent Application No. 62/757,341 for "Container Configured to Collect and Retain Fluid Shed from Container Contents" (filed Nov. 8, 2018), which is hereby incorporated by reference in its entirety.

BACKGROUND

The present invention generally relates to packages configured to collect and retain fluid shed from container contents and, more specifically, to packages configured to collect and retain fluid shed from fresh meat.

It is conventional for a package containing fresh meat to include a tray containing an absorbent pad. Fresh meat, for example poultry, beef, pork, fish, or seafood, can be placed on the absorbent pad in the tray, and the tray can be closed with an overwrap.

The absorbent pad can be a significant portion of total package cost. The tray and absorbent pad are typically formed separately from one another, so that the absorbent pad has to be placed in the tray.

The absorbent pad creates an offset due to its thickness, and the absorbent pad also increases the stack height of a given number of trays. This reduces the efficiency of shipping stacks of the trays.

Many consumers have a negative reaction to dealing with the absorbent pad, which is typically soaked with fluid from the fresh meat.

Spoilage of fresh meat, particularly seafood, may be accelerated when the food product is in contact with liquids coming from the fresh meat product. Therefore, it is typically desirable to separate the liquids from fresh meat products. Whereas absorbent pads can be used to separate such liquids from fresh meat products, there are drawbacks to using the absorbent pads.

SUMMARY

An aspect of this disclosure is the provision of a container configured to at least partially contain content(s) that shed fluid (e.g., fresh meat). The container typically includes a base panel above which an interior space of the container is defined, wherein the base panel is configured to support the fresh meat and/or other content(s). A plurality of elongate interior passageways can be at least partially defined in the base panel. A plurality of openings can be respectively open to the plurality of interior passageways. The plurality of openings can be configured to allow fluid from the fresh meat and/or other content(s) in the container to flow into the plurality of interior passageways. The container can be configured to at least partially retain the fluid in the plurality of interior passageways. For example, opposite end sections of at least some of the interior passageways can be closed to at least partially define compartments for receiving and retaining the fluid.

The base panel can include upper and lower walls between which the plurality of interior passageways are at least partially defined. At least some openings of the plurality of openings can be defined in the upper wall of the base panel.

At least the base panel can be an extruded, polymeric base panel. The container can include at least one side panel connected to the base panel and extending at least partially around the interior space of the container.

Other aspects of this disclosure include the provision of blanks for being formed into containers of the above-described type, and associated methods.

The foregoing summary provides a few brief examples and is not exhaustive, and the present invention is not limited to the foregoing examples. The foregoing examples, as well as other examples, are further explained in the following detailed description with reference to accompanying drawings.

BRIEF DESCRIPTION OF THE DRAWINGS

The drawings are provided as examples, and they are schematic and may not be drawn to scale. The present invention may be embodied in many different forms and should not be construed as limited to the examples depicted in the drawings.

DETAILED DESCRIPTION

Examples of embodiments are disclosed in the following. The present invention may, however, be embodied in many different forms and should not be construed as limited to the embodiments set forth herein. For example, features disclosed as part of one embodiment or example can be used in the context of another embodiment or example to yield a further embodiment or example. As another example of the breadth of this disclosure, it is within the scope of this disclosure for one or more of the terms "substantially," "about," "approximately," and/or the like, to qualify each of the adjectives and adverbs of the Detailed Description section of disclosure, as discussed in greater detail below.

Figure 1:
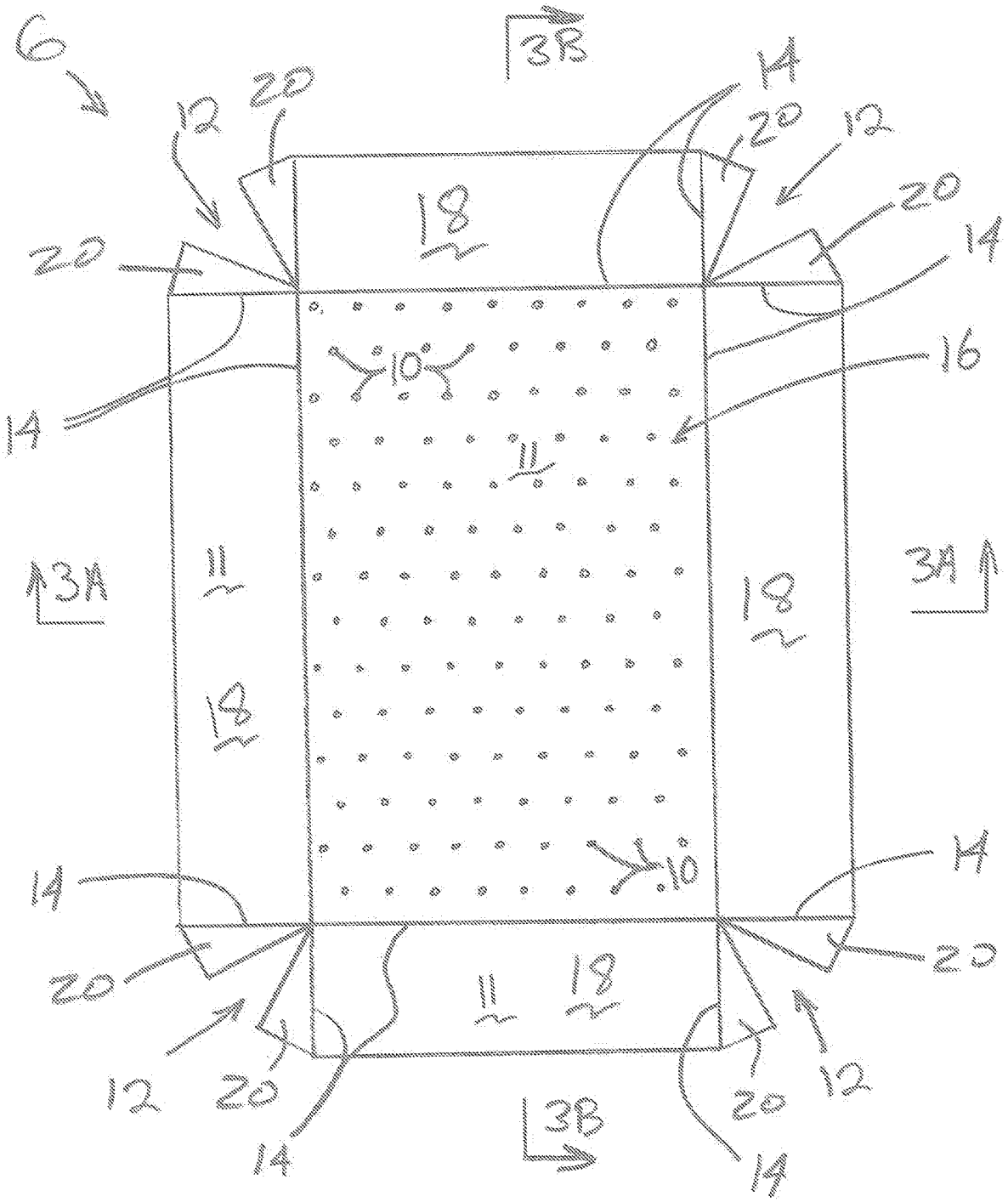
FIG. 1 is a top plan view of a flat blank formed from an extruded polymeric sheet having elongate interior passageways or flutes, in accordance with a first version of a first embodiment of this disclosure.
Figure 2:
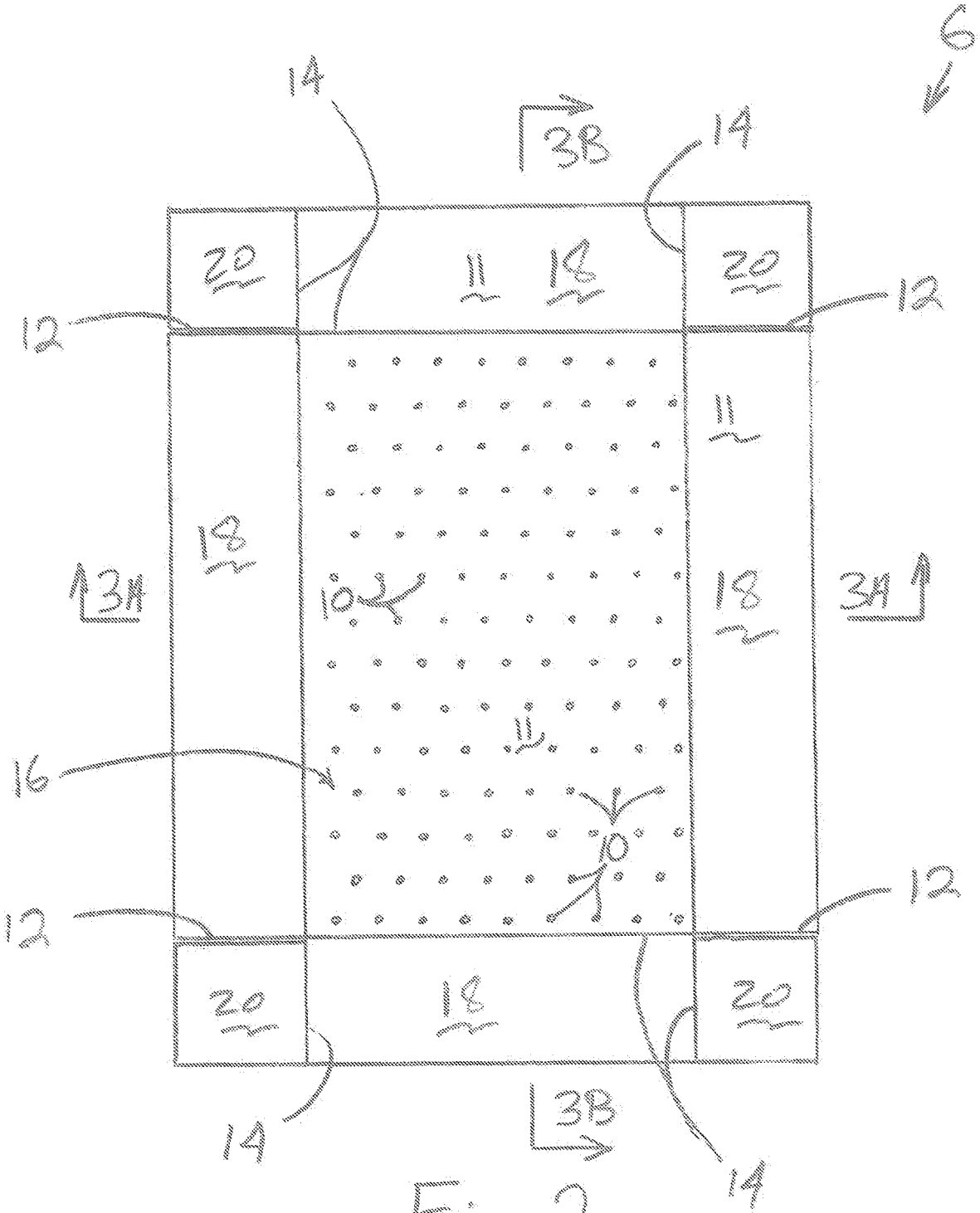
FIG. 2 is similar to FIG. 1 and depicts a blank of a second version of the first embodiment.

Referring to FIGS. 1 and 2 and in accordance with a first embodiment of this disclosure, blanks 6 can be constructed from conventional extruded polymeric sheets having elongate, interior passageways (see, e.g., flutes or passageways 8 in FIG. 3) that extend in the longitudinal (e.g., lengthwise) direction of the blank. That is, the first embodiment blanks 6 can be formed from fluted and/or corrugated plastic (e.g., polymeric) sheets that are formed by extruding the polymeric material by forcing it through a die. Openings 10 to the passageways 8 (also see, e.g., FIG. 3) are formed in the blanks 6. As an example, the openings 10 can be holes or slits punched or cut in only upper walls 11 (also see, e.g., FIG. 3) of the blanks 6, or in only the upper walls 11 of central or base panels 16 of the blanks. As a more general example, the openings 10 can be mechanically created, created by laser cutting, and/or created in any other suitable manner. In the containers formed from the blanks 6, the openings 10 to the passageways 8 are configured to direct fluids from contents of the containers (e.g., food typically in the form of fresh meat) into otherwise closed passageways 8 in a predetermined manner that seeks, for example, to obviate including absorbent pads in the containers, as will be discussed in greater detail below, FIGS. 1 and 2 depict examples of different versions of the first embodiment blanks 6. FIG. 1 depicts a first version or example of the blank 6, and FIG. 2 depicts a second version or example of the blank 6. More generally, the blanks 6 can be configured differently than depicted in the drawings, for example as discussed in greater detail below.

Referring to FIGS. 1 and 2, for forming the first embodiment blanks 6, the extruded, corrugated, polymeric sheet is cut so that the blank includes cuts 12 (e.g., holes or cut-outs formed by cuts in FIG. 1, and slits in FIG. 2). Optionally lines of disruption 14 (e.g., fold lines and/or seams) are also formed in the blanks 6. Each line of disruption 14 can be formed by applying mechanical pressure (e.g., crimping and/or scoring) at the line of disruption (e.g., folding to form the line of disruption), and/or by substantially simultaneously applying both heat and mechanical pressure at the line of disruption. The heat can be provided, for example, by way of heat transfer, ultrasonic energy, electron beam(s), laser beam(s) and/or any other suitable techniques. More generally, the lines of disruption 14 can be formed by applying mechanical force or pressure and/or by thermally heating in a variety of ways. In one example, one or more of the lines of disruption 14 of a blank 6 and/or container erected from the blank can be formed mechanically without heating, whereas one or more of the other lines of disruption of the same blank can be formed using only thermal energy, for example for achieving different benefits in different parts of the container formed from the blank.

In the first embodiment, respective lines of disruption 14 are positioned between the base panels 16 and one or more side panels 18 of the blanks 6. The respective lines of disruption 14 can at least partially close (e.g., hermetically seal closed) opposite ends of the interior passageways 8 (FIG. 3) in the base panel 16. Alternatively, the fold lines or lines of disruption 14 may not be formed in the flat blank 6. Rather, the lines of disruption 14 may be formed while the blank 6 is being erected into a tray or other suitable container (e.g., a box).

In the first version of the blank 6 depicted in FIG. 1, the side panels 18 are rectangular, and triangular or generally triangular flaps 20, or the like, are connected to opposite ends of the side panels by respective lines of disruption 14. In the first version of the blank 6, each side panel 18 and the flaps 20 connected thereto collectively form a shape that is generally trapezoidal. In contrast to the first version blank 6, the example of the second version blank 6 depicted in FIG. 2 has rectangular or square flaps 20 connected by lines of disruption 14 to opposite ends of the relatively short side panels 18. The flaps 20 of the first and second versions of the blank 6 are configured for use in closing upright corners of the tray or other container formed from the blank, as will be discussed in greater detail below. Whereas it is believed that it may be preferred in some examples for the side panels 18 to be rectangular, the present disclosure is not limited to such rectangular configurations. For example, other suitable configurations (e.g., shapes) are within the scope of this disclosure.

Other variations and features of the blank 6 are also within the scope of this disclosure. For example, other flaps (not shown) can be pivotably (e.g., foldably) connected to the outer edges of the side panels 18, such as for use in forming a flange or other suitable features in the tray or other container formed from the blank 6. As a further example, U.S. Pat. No. 4,265,390 is incorporated herein by reference for its disclosure of blank(s) and tray(s) erected from such blank(s). Other suitable blanks, containers, trays, and boxes are within the scope of this disclosure.

Figure 3:
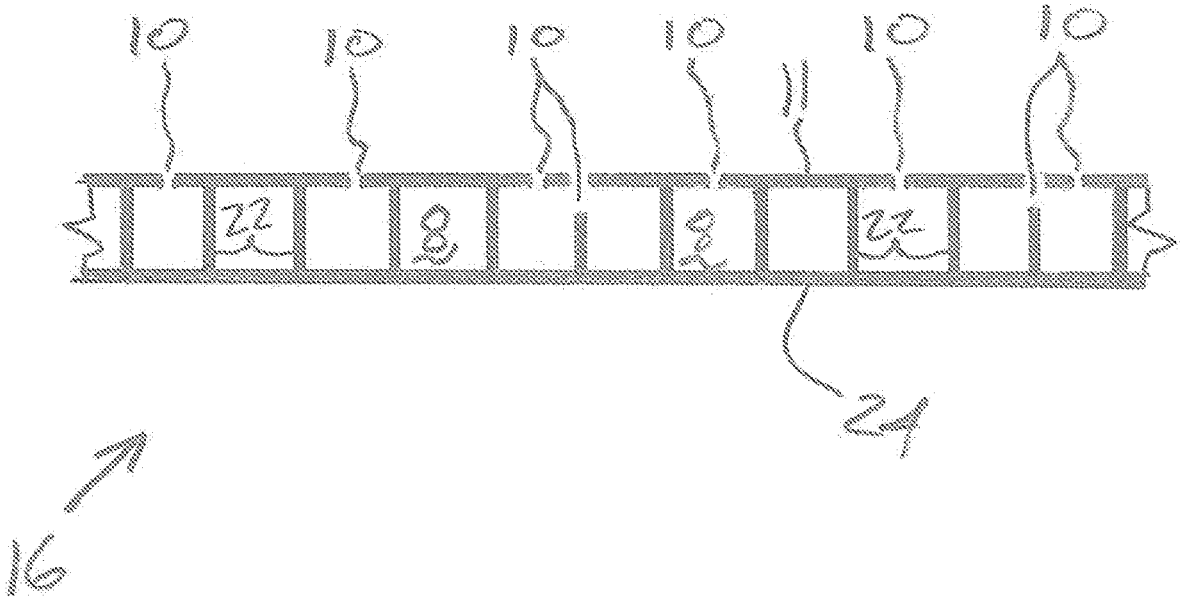
FIG. 3 is a cross-sectional view of a portion of a base panel of a blank, wherein the cross-section of FIG. 3 is taken along lines 3A-3A of FIGS. 1 and 2 for the first embodiment, and the cross-section of FIG. 3 is taken along lines 3B-3B of FIGS. 1 and 2 in accordance with a second embodiment of this disclosure.

Referring to FIG. 3, in the first embodiment, the extruded, corrugated, polymeric sheets, and, thus, the blanks 6, or at least the base panels 16 of the blanks, comprise, consist essentially of, or consist of, an extruded, corrugated, polymeric sheet having connector webs 22 integrally formed with, connecting, and spanning crosswise (e.g., perpendicular to) opposite upper and lower walls 11, 24 of the sheet. In the first embodiment, each of the elongate connector webs 22 extends in the longitudinal (e.g., lengthwise) direction of the blank 6, and the connector webs are serially spaced apart from one another in a direction extending crosswise to the longitudinal direction. Alternatively, each of the elongate connector webs 22 can extend in the width-wise (e.g., crosswise) direction of the blank 6, so that the connector webs are serially spaced apart from one another in the longitudinal direction, as discussed in greater detail below.

In the example depicted in FIG. 3, each interior passageway 8 (e.g., flute) is defined between a pair of adjacent connector webs 22 and between respective portions of the upper and lower walls 11, 24, and the openings 10 extend through the upper wall 11 of the base panel 16 and are respectively in fluid communication with the interior passageways 8 of the base panel 16. In the examples of FIGS. 1 and 2, a plurality or multiplicity of the openings 10 extend through the upper wall 11 of the base panel 16, although only a few of the openings 10 are specifically identified by their reference numeral (i.e., "10") in FIGS. 1 and 2.

In the first embodiment, for at least some of, the majority of, or each of the interior passageways 8 of the base panel 16, a series of the openings 10 are spaced apart along, and are in fluid communication with, the interior passageway. In the first embodiment, the openings 10 are omitted from the lower wall 24 of the base panel 16, and the openings 10 are omitted from the upper and lower walls 11, 24 of the side panels 18. Alternatively, openings 10 may be included in the upper walls 11 of the side panels 18.

It is believed that suitable extruded, corrugated, polymeric sheets for forming the blanks 6 or containers of this disclosure may include any suitable multi-layer sheet configuration having cavities, chambers, compartments, and/or the like between its outer walls. For example, the webs 22 (FIG. 3) may define wavy or undulating shapes. As another example, additional interior layer(s) or walls of the extruded, corrugated, polymeric sheet may be shaped as "bubbles" or alternating half-cups, semi-spheres, and/or form X-shaped cross-sectional patterns instead of "vertical flutes."

The extruded, corrugated, polymeric sheets can be constructed of polypropylene or any other suitable polymeric materials. The extruded, corrugated, polymeric sheets can be produced from (e.g., extruded from) polypropylene of various grades and types. Alternatively, the extruded, corrugated, polymeric sheets may be produced from (e.g., extruded from) other plastic types such polystyrene, amorphous polyester (APET), and other plastics commonly used in food packaging. Optionally, the extruded, corrugated, polymeric sheet material can be coated and/or laminated together with one or more additional layers of suitable material.

Figure 4:
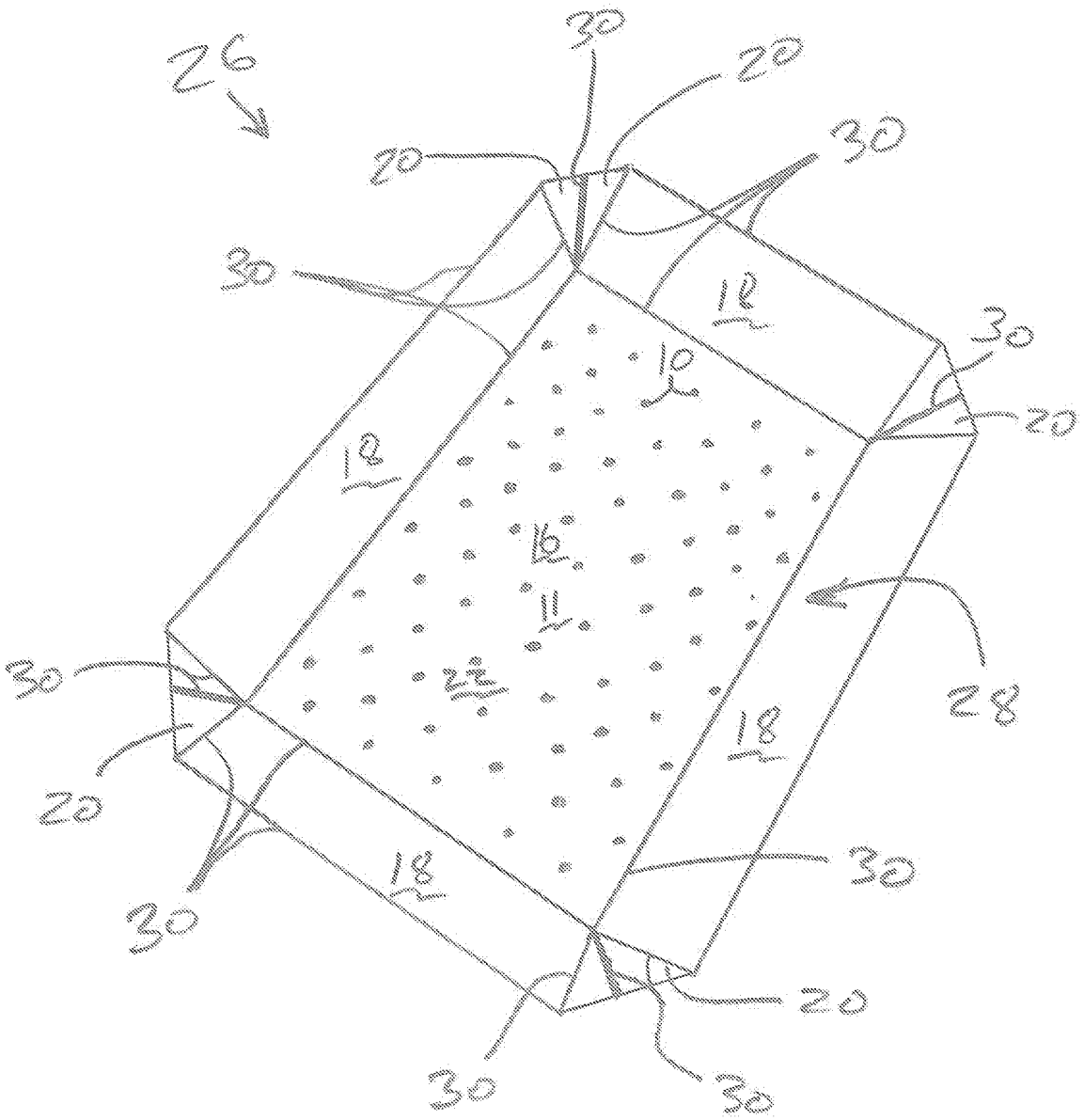
FIG. 4 is a top perspective view of a container formed from the blank of FIG. 1, in accordance with the first version of the first embodiment.
Figure 5:
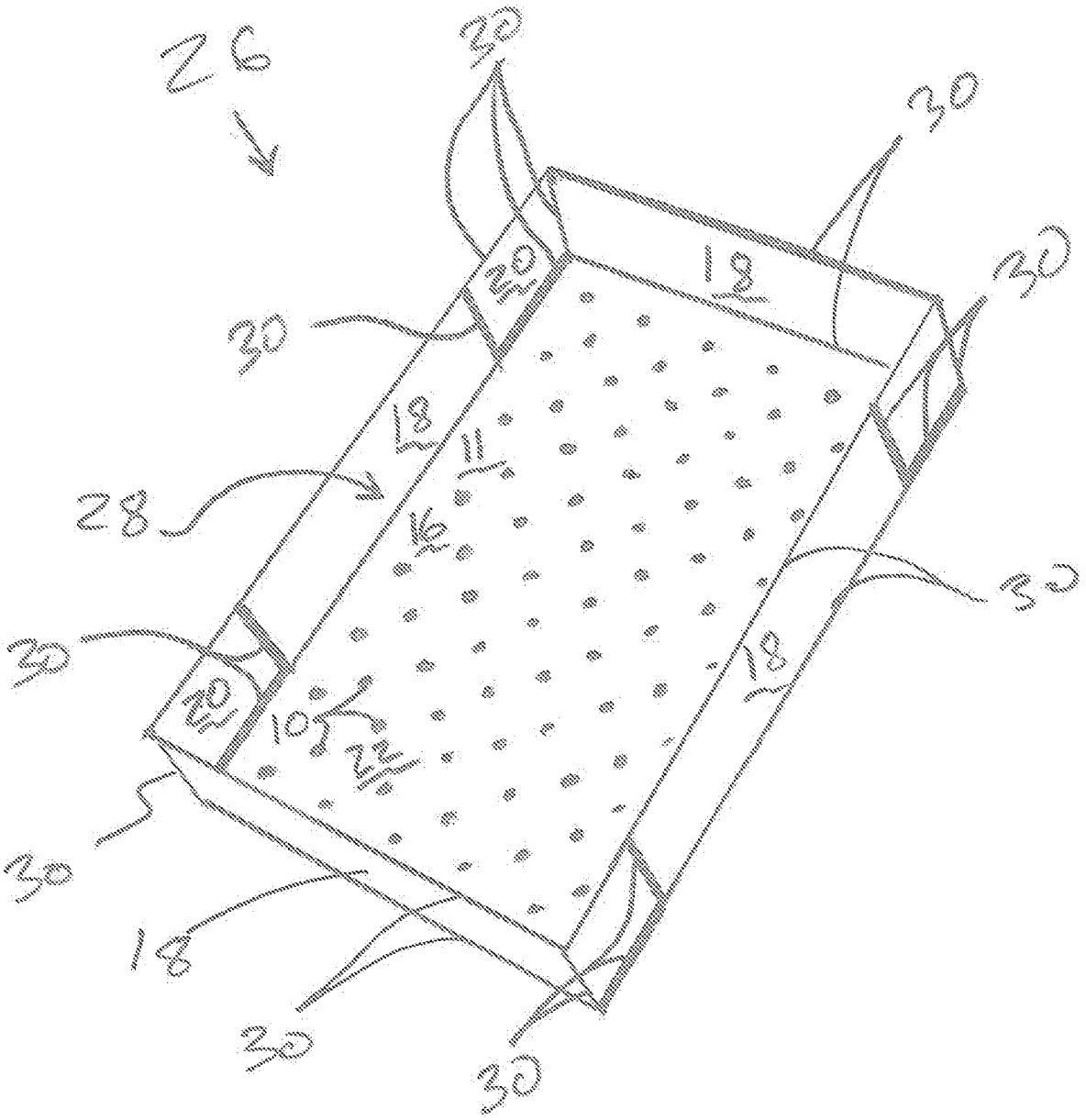
FIG. 5 is a top perspective view of a container formed from the blank of FIG. 2, in accordance with the second version of the first embodiment.

FIGS. 4 and 5 are top perspective views of examples of containers 26 (e.g., trays) formed from the blanks 6 of FIGS. 1 and 2, respectively. In each of FIGS. 4 and 5, the side panels 18 extend upwardly from peripheral edges of the base panel 16, and the side panels extend around the interior space 28 of the container or tray 26. In FIGS. 4 and 5, the trays 26 are viewed from above, so that the interior space 28 is upwardly open and viewed from above.

Each of the blanks 6 of FIGS. 1 and 2 can be at least partially formed into the containers or trays 26 of FIGS. 4 and 5, by, for example, folding the side panels 18 upwardly and inwardly, and folding the flaps 20 inwardly, along respective lines of disruption 14 (see, e.g., FIGS. 1 and 2) until respective portions (e.g., edges and/or marginal portions) of adjacent side panels and/or flaps are adjacent, abutting, or overlapping one another to at least partially form upright corners of the tray or other suitable container.

Referring to FIGS. 4 and 5, in each upright corner, the respective abutting or overlapping edges can be securely fastened to one another by forming sealed areas or seams 30 (e.g., abutment seams, sealed overlap seams and/or otherwise suitable seams) so that the corners are sealed closed. The seams 30 are typically hermetically sealed seams that can be formed by applying adhesive material, mechanical fasteners, and/or plastic welding. Plastic welding can include, for example, applying mechanical pressure and heating, wherein the heating can be provided, for example, by way of heat transfer, ultrasonic energy, electron beam(s), laser beam(s) and/or any other suitable techniques.

As an example for the version of the container or tray 26 depicted in FIG. 4, the side panels 18 can each extend upwardly and outwardly from the base panel 16 so that the side panels collectively extend around an upwardly open cavity of the container. With the containers or trays 26 in this configuration, the trays can be "nested" in a stacked configuration (e.g., fit close together, with one at least partially within the other).

The corner seams 30 can at least partially close (e.g., hermetically seal closed) opposite ends of the interior passageways 8 in at least some of the side panels 18 and/or flaps 20. Alternatively and/or additionally, at least some of, the majority of, or each of the opposite ends and/or intermediate portions of the interior passageways 8 of the base panel 16 and/or side panels 18 can be at least partially closed (e.g., hermetically sealed closed) by substantially simultaneously applying thereto both heat and mechanical pressure, wherein the heating can be provided, for example, by way of heat transfer, ultrasonic energy, electron beam(s), laser beam(s) and/or any other suitable techniques. In this regard, one or more of, or each of, the lines of disruption 14 can be in the form of a sealed seam 30. Similarly, one or more of, or each of, the upper edges of the trays 26 can be "finished" by being in the form of a sealed seam 30.

The blanks 6, panels 16, 18, flaps 20, containers 26, and associated features can be configured differently than depicted in FIG. 1-4. For example and at least partially reiterating from above, the side panel(s) 18 can be non-rectangular and/or have other features connected thereto, for example mechanical fasteners and/or flaps. As another example, the base panel 16 can be part of a variety of differently configured blanks, for example blanks for being formed into boxes or other suitable containers. For example, the blanks 6 can be configured for being erected to form a box with folded corners and locks to hold its shape.

After the trays 26 or other suitable containers are formed from the blanks 6, one or more articles can be placed in the interior space 28 of each container or tray. For example, the one or more articles or contents placed in the container or tray 26 can be conventional and may shed fluid. As a more specific example, one or more pieces of fresh meat, such as poultry, beef, pork, fish, or seafood can be placed directly onto the upper surface 11 of the base panel 16, and then the tray or container 26 may be closed. For example, the upper opening to the interior 28 of the tray 26 can optionally be closed with a conventional polymeric film overwrap and/or any other suitable structure(s).

At least partially reiterating from above, opposite ends of the interior passageways 8 in the base panel 16 can be at least partially closed (e.g., hermetically sealed closed) by respective lines of disruption 14, seams 30, and/or other suitable features, so that at least some of, the majority of, or each of the interior passageways of the base panel 16 is in the form of a chamber or compartment (e.g., collection and retention compartment) that is fully closed, except for being upwardly open at one or more of the openings 10 in the upper wall 11 of the base panel 16. In the first embodiment, at least some of, the majority of, or each of the collection and retention compartments in the base panel 16 and its associated opening(s) 10 are cooperatively configured so that the collection and retention compartment is configured to collect and retain fluid shed from the meat and/or other content(s) supported by the upper wall 11 of the base panel.

The collection and retention compartments can capture and hold the fluids from the meat and/or other content(s) supported by the upper wall 11 of the base panel. In the first embodiment, the collection and retention compartments are completely separated (e.g., divided) from one another by way of, for example, the connector webs 22 (FIG. 3) or other suitable structures. In the first embodiment, the separated or divided collection and retention compartments are configured to restrict the fluids captured therein from sloshing in a manner that is similar to how baffles operate in fuel tanks in airplanes and automobiles. It is believed that, in an alternative embodiment, adjacent collection and retention compartments (e.g., passageways 8) may be in fluid communication with one another, for example by way of one or more openings or holes therebetween that extend through the intervening web 22, so that the collection and retention compartments are configured to allow the fluids captured therein to flow between the collection and retention compartments in a predetermined (e.g., controlled and restricted) manner, for example in a manner that is similar to how baffles operate in fuel tanks in airplanes and automobiles.

Any openings or holes that extend through the webs 22 can be formed, for example, when the holes 10 in the base upper wall 11 are formed. For example, a hole 10 extending through the base upper wall 11 can extend into at least an upper portion of an associated web 22 (without extending through the base lower wall 24) so that the portion of the hole 10 defined in the web 22 is open to both of the passageways 8 that are partially defined by the associated web 22. As a more specific example, openings between adjacent passageways 8 may be created by cutting or melting holes 10 (e.g., slots) through the base interior surface 24 and into the webs 22 to a partial depth of the thickness of the base 16. Such a slot 10 penetrating a web 22 to a sufficient depth and open to both passageways 8 adjacent to the penetrated web would create paths for fluid to flow into the adjacent passageways 8 from above and a path for the fluid to flow between the adjacent passageways 8. It is believed that such a slot 10 may be relatively small, for example by being just wide enough to allow fluid to flow therethrough, and long enough to extend completely through the thickness of one of the webs 22. It is believed that such slots 10 may be created with a heated forming tool that has many strategically positioned or randomly placed tips that would create the slots so that they extend crosswise (e.g., perpendicular) to the lengths of the passageways 8 and webs 22.

At least partially reiterating from above, at least some of, the majority of, or each of the portions of the interior passageways 8 positioned at the edges of the container 26 (e.g., tray), the edges base panel 16, the edges of the side panels 18, and/or edges of the flaps 20 can be at least partially closed (e.g., hermetically sealed closed) by plastic welding (e.g., heat sealing, adhesive material, mechanical fasteners, and/or applying mechanical force (e.g., crimping and/or folding)) in a manner that forms respective seams 30. The resulting seals in the interior passageways 8 can be configured in a manner such that the liquids trapped in the collection and retention compartments cannot escape out of the ends of the interior passageways that define the collection and retention compartments.

More generally regarding the above-discussed upright corners of the tray 26 or other suitable container of the first embodiment, these upright corners are typically hermetically sealed closed (e.g., by respective seams 30) so that the resulting tray or container, as a whole, is leak-proof. The upright corners being hermetically sealed closed seeks to help facilitate the directing of any liquids shed from the contents of the tray 26 or other suitable container toward the collection and retention compartments.

The extruded, corrugated, polymeric sheets can be produced in a range of thicknesses (e.g., in a range of from about two millimeters to about 10 millimeters) and with different frequency or density of interior passageways 8. These variations can be used to adjust the liquid holding capacity of the collection and retention compartments so that they can be advantageously customized for different types and quantities of package contents (e.g., fresh meat).

For erecting the blanks 6, or forming the trays 26 or other suitable containers more directly from the extruded, corrugated, polymeric sheets, it is believed that an extruded, corrugated, polymeric sheet can be formed or shaped using forming tools at least similarly as is done with solid plastic sheet and foamed plastic sheet. A combination of controlled heat, mechanical pressure and vacuum in the forming tool can aid the formation of the tray 26 or other suitable container. As examples, it is believed that the forming tool can be either a one-sided or two-sided thermal forming tool, as discussed below.

In a one-sided thermal forming tool, typically the tool comes into contact with the side 24 (FIG. 3) of the blank 6, or the like, that forms the outside of the container or tray 26. Alternatively it is believed that the tool can come into contact with the opposite side 11 of the blank 6. The one-sided thermal forming tool can be referred to as a thermoforming or vacuum forming tool. In this regard, a vacuum may be used to pull the softened, fluted plastic sheet against the tool such that the fluted polymeric sheet takes on the shape of the tool.

In a two-sided thermal forming tool, two tools are used, one on each side of the blank 6, or the like. The fluted plastic blank 6, or the like, is heated and the tool associated with the part inside (e.g., wall 11) pushes the fluted plastic sheet into the cavity of the tool that forms the outside of the part (e.g., wall 24). Vacuum may or may not be used. For the blanks 6 and containers 26, the two sided-tool may have advantages, such as: (i) lower heat may be required to form the container or tray 26 which may be beneficial to prevent any collapse of the passageways 8, and (ii) the tools may be designed such that one or more pinch-points or pinch-lines (e.g., seal(s) 30) are created at a location in the container or tray 26 to form the collection and retention compartments (e.g., by closing at least a portion of at least some of the interior passageways 8). For example, it is believed that with such a two-sided thermal forming tool, the passageways 8 in the upper section of the container or tray 26 (e.g., upper sidewalls 18 and any flange or rim) may be collapsed fully to trap the fluid in the uncollapsed portions of the passageways 8 and create a more finished edge to the tray while the lower sidewalls 18 and base wall 16 maintain the full interior cavities 8 of the initial fluted polymeric sheet structure.

The edges (e.g., edges of the blanks 6) can be sealed during blanking, during forming of the container 26 (e.g., tray), or after forming of the container. The edge seals can be located in an upper flange located at the upper periphery of the container or tray 26 and/or in any other suitable location. Tray edges can be sealed after forming the tray by applying, for example, heat and/or adhesive material (e.g., caulk and/or hot-melt adhesive).

The openings 10 (e.g., holes or slits used for drainage) can be incorporated during the blanking process, during the forming of the container 26 (e.g., tray), or after the container is formed.

The trays 26 or other suitable containers can be formed and "locked-in-place" using an insert injection molding process. More specifically, the blank 6 can be inserted in an injection mold and after mold closure, polymer such as polypropylene, can be injected around the rim of the tray flange and/or along the upright corners of the tray. For example, the injection molding tool could have extra cavities at the flange region and/or upright corners of the container or tray 26 to accept the additional polymer. When cool, the injected flange could hold the extruded, corrugated, polymeric sheet in position and define the upper tray shape and/or the polymer injected in the upright corners of the container or tray could seal closed the upright corners.

The extruded, corrugated, polymeric sheet can be any color to color-code trays 26 for different contents, e.g. fresh poultry, beef, pork, fish or seafood. The extruded, corrugated, polymeric sheet tray 26 could also be made from natural, uncolored PP, typically translucent, to allow the trapped fluids to be observed, if desired. For any color, the extruded, corrugated, polymeric sheet can be produced using a coextrusion process wherein the interior of the sheet can be a different color than the exterior. For example, white outer skins and a black interior can completely block any visibility of the trapped liquids while still having a light-colored exterior.

The forming of the trays 26 or other suitable containers can be accomplished through the application of mechanical pressure, thermal heat and folding of the extruded, corrugated, polymeric sheet or any combination thereof. If the container forming is done as a set-up box, the tray or box assembly can be accomplished either by hand assembly or machine assembly. If tray forming is done as a set-up box, the tray shape can be held in-place with a wide range of lock designs commonly used with corrugated paper and extruded, corrugated, polymeric sheet box designs. If the tray or other suitable container is formed only with mechanical pressure or formed by folding assembly, the final shape can be locked in position using an outer ring around and under the upper flange. The outer ring can be metal, plastic or other effective material.

When the tray or other suitable container is formed with the aid of thermal energy to soften or at least partially melt the fluted polymeric sheet, the application of vacuum on both sides of the tool, and hence both sides of the extruded, corrugated, polymeric sheet, can serve to avoid collapse of the interior passageways 8 that are to be preserved for trapping fluids.

Sealing edges before tray forming and not forming the openings 10 in the upper wall 11 prior to tray forming can serve to trap air inside the interior passageways 8. The trapped air can help maintain inner and outer wall separation to preserve the interior passageways 8 for holding the collected fluids.

The extruded, corrugated, polymeric sheet typically has the interior passageways 8 extending in one direction. This direction is generally stiffer or more rigid than the non-flute direction. The orientation of interior passageways 8 can be positioned relative to the final tray design to achieve the best tray performance.

The container or tray can be formed by folding the blank 6, or a variation thereof with additional and/or differently configured side panels and flaps, into a box shape. The box can be held in shape using folding techniques or by applying adhesive material to adjacent edges. Sealing can be accomplished using plastic welding either in a secondary process or directly in the box set up apparatus.

The amount of fluids contained in the collection and retention compartments can be modified for specific applications by sealing off different portions of, for example, the base panel 16 and side panels 18. For example, for low fluid containment applications the container or tray may only be sealed in a rectangle in the center of the base panel 16, to form the collection and retention compartments only in the center area of the base panel. In such an implementation, typically the openings 10 would be present only in the central area of the upper wall 11 of the base panel 16. For at least some fold-up containers (e.g., boxes or trays), the hinge points (e.g., lines of disruption or fold lines) between the base and side panels 16, 18 may be sealed to contain the fluids only in collection and retention compartments of the base panel.

Containers (e.g., trays or boxes) of this disclosure can be either hand-folded or machine assembled. To increase strength in two or four of the side panels of the container or tray, the size of the blank can be extended in the desired dimension, and the extra material can be folded over the tray rim and down the outer sidewall. The extra material can be joined to the body of the container or tray with adhesive, contact thermal welding, or ultrasonic welding.

The openings 10 can be configured (e.g., shaped and sized) so that the openings 10 readily receive drained fluids and direct them, for example under the force of gravity, inwardly into the respective collection and retention compartments. The openings 10 can also be configured to restrict flow therethrough outwardly from the collection and retention compartments. For example, at least some of, or each of, the openings 10 can be punched or otherwise formed in the respective wall 11 (e.g., upper wall) of the extruded, corrugated, polymeric sheet so that the opening defines a tapered configuration (e.g., a frustoconical or funnel shape) having a relatively smaller dimension or diameter and a relatively larger dimension or diameter that are spaced apart along the length of the opening. The relatively smaller dimension or diameter can be defined in, or closer to, the interior surface of the wall 11, and the relatively larger dimension or diameter can be defined in, or closer to, the exterior surface of the wall 11. As another example, at least some of, or each of, the openings 10 can be configured to function like a check valve, for readily allowing flow therethrough into the respective collection and retention compartment, and restricting flow therethrough outwardly from the respective collection and retention compartment. For example, it is believed that such a check-valve type of opening, or the like, may be provided by cutting a partial hole around a significant portion of the holes' circumference, while leaving a joining section. It is believed that the cut portion can produce, define, or function as a "flap" that functions as a one-way check valve.

A second embodiment of this disclosure is like the first embodiment, except for variations noted and variations that will be apparent to those of ordinary skill in the art. Referring to FIG. 3, in the second embodiment, each of the elongate connector webs 22 extend in the width-wise (e.g., crosswise) direction of the blank 6, and the connector webs are serially spaced apart from one another in the longitudinal direction.

Figure 6:
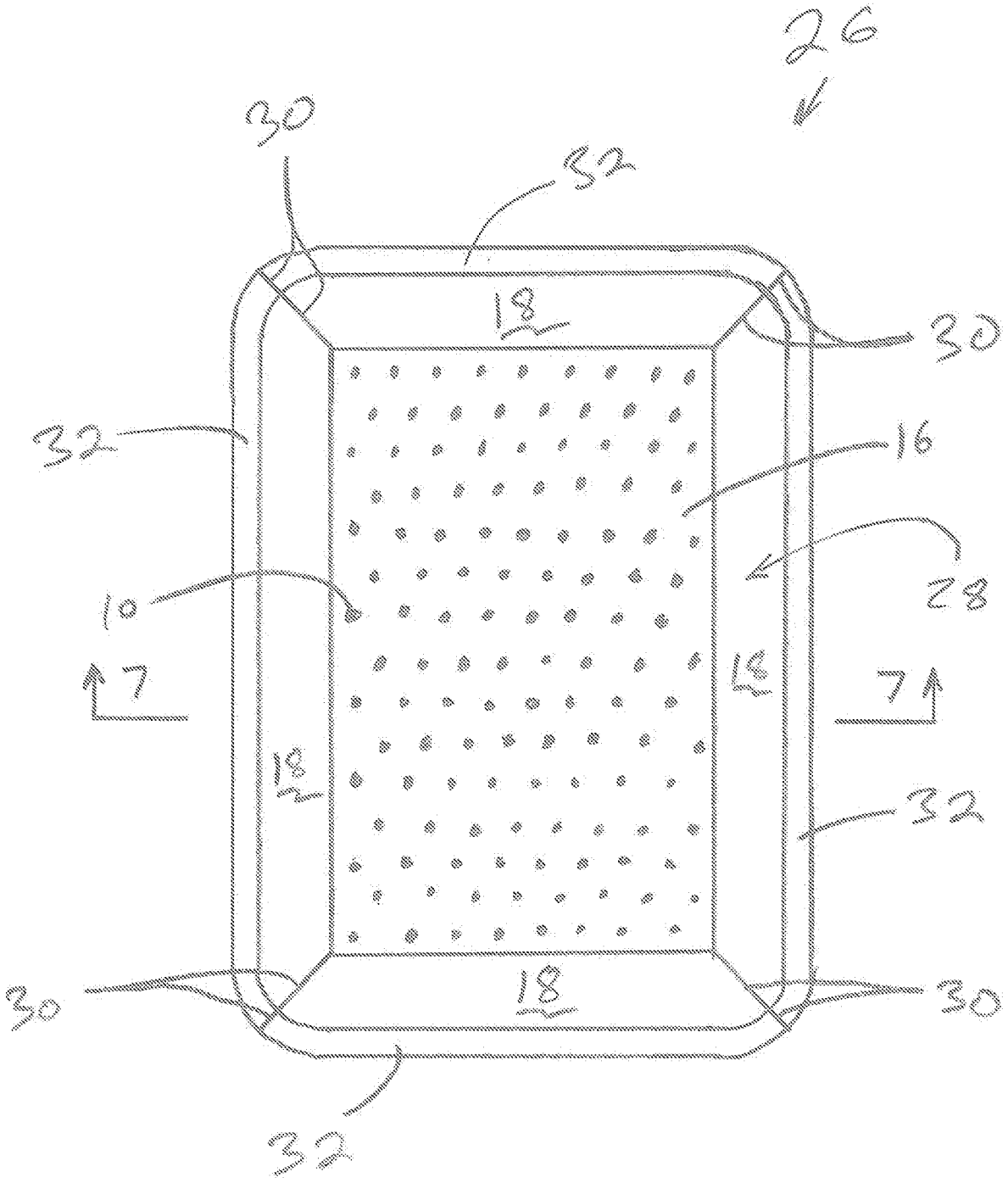
FIG. 6 is a top plan view of a container formed from the blank of FIG. 1, or the like, in accordance with a third embodiment of this disclosure.

A third embodiment of this disclosure is like the first and second embodiments, except for variations noted and variations that will be apparent to those of ordinary skill in the art. In the third embodiment and at least partially reiterating from above, a thermal forming tool can be used to form the blank 6 of FIG. 1, or the like, into the container or tray 26 depicted in FIGS. 6 and 7, so that an annular flange 32 extends outwardly from upper edges of the side walls 18.

Figure 7:
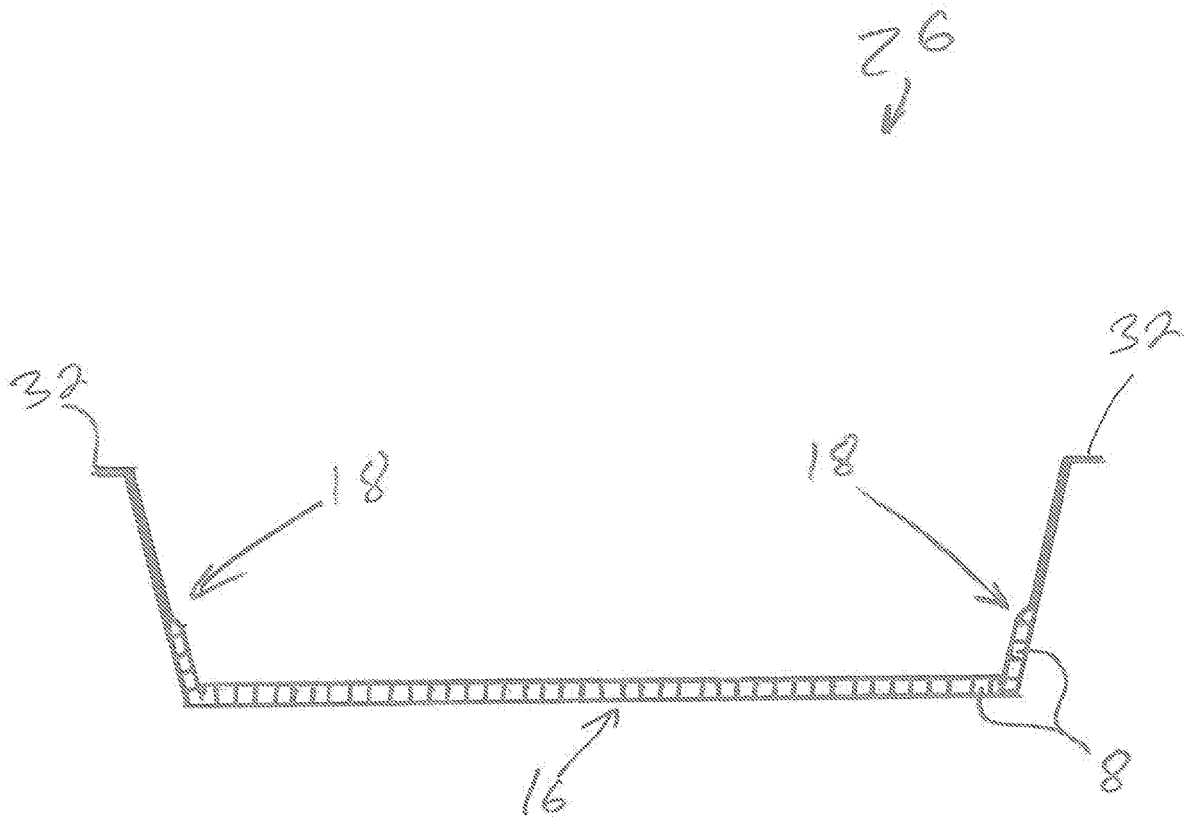
FIG. 7 is a cross-sectional view taken along line 7-7 of FIG. 6, wherein only the cross sectioned portions of the container are depicted.

In the third embodiment, the passageways 8 in portions of the fluted sheet that form the flange 32 and at least the upper portions of the one or more side walls 18 can be at least partially collapsed, or completely collapsed, for example as depicted in FIG. 7. The portions of the container or tray 26 including the collapsed passageways 8 typically have a thickness that is thinner than the portions of the container in which the passageways are not collapsed. An upper portion of the container or tray 26 can include a plurality of passageways 8 and/or portions of the passageways that are collapsed or at least partially collapsed. The plurality of passageways 8 and/or portions of the passageways that are collapsed or at least partially collapsed can extend around or at least partially around all of or a portion of (e.g., an upper portion of) the interior space 28 (e.g., an opening to the interior space).

In accordance with the above-described embodiments, a fold line can be any substantially linear, although not necessarily straight, form of weakening that facilitates folding along the fold line. More specifically, but not for the purpose of narrowing the scope of this disclosure, fold lines can include: a score line, such as lines formed with a blunt scoring knife (which may optionally be heated to at least partially melt the extruded, corrugated, polymeric sheet), or the like, which creates a "crushed" portion in the material along the desired line of weakness; a cut that extends partially into a material along the desired line of weakness; a series of cuts that extend partially into the material along the desired line of weakness; various combinations of these features; and/or other suitable features.

In the foregoing, the tray, container or package contents are frequently referred to as being meat, for example fresh meat. Notwithstanding, the contents can be any other suitable contents, for example contents that may shed fluid (e.g., food items such as, but limited to, fruits and vegetables). As another example, in the foregoing the container or tray is typically described as including side panels or walls. Notwithstanding, the sidewalls may be replaced with and/or be in the form of raised edges of the base panel and/or other suitable structures. Alternatively, it is believed that in some implementations the side panels, sidewalls, raised edges, or the like, may be omitted.

To supplement the present disclosure, this application incorporates by reference the entire disclosure of each of U.S. Pat. Nos. 4,265,390 and 8,784,959.

Reiterating from above, it is within the scope of this disclosure for one or more of the terms "substantially," "about," "approximately," and/or the like, to qualify each of the adjectives and adverbs of the foregoing disclosure, for the purpose of providing a broad disclosure. As an example, it is believed that those of ordinary skill in the art will readily understand that, in different implementations of the features of this disclosure, reasonably different engineering tolerances, precision, and/or accuracy may be applicable and suitable for obtaining the desired result. Accordingly, it is believed that those of ordinary skill will readily understand usage herein of the terms such as "substantially," "about," "approximately," and the like. As another example, variations may be introduced when the blanks 6 are manufactured by passing a web of precursor material through one or more die stations including cutting and scoring dies, or the like. For example, variations may occur as dies wear and/or are replaced, or the like. Those of ordinary skill in the art will understand that, in such a manufacturing process, typically there are engineering tolerances comprising permissible limits in variations of dimensions, and the tolerances can vary in different circumstances. Accordingly, it is believed that those of ordinary skill will readily understand usage herein of the terms such as "substantially," "about," "approximately," and the like.

In the specification and drawings, examples of embodiments have been disclosed. The present invention is not limited to such exemplary embodiments. The use of the term "and/or" includes any and all combinations of one or more of the associated listed items. Unless otherwise noted, specific terms have been used in a generic and descriptive sense and not for purposes of limitation.

What is claimed is:

1. A container for fresh meat, the container comprising:

an extruded, polymeric base panel above which an interior space of the container is defined, wherein the base panel comprises upper and lower walls that are opposite from one another, and the upper wall is configured to support fresh meat positioned in the interior space of the container;

a plurality of elongate interior passageways at least partially defined in the base panel; and a plurality of openings extending through the upper wall and respectively open to interior passageways of the plurality of interior passageways, the plurality of openings being configured to allow fluid from the fresh meat to flow from the interior space of the container respectively into the interior passageways, wherein the container is configured to at least partially retain the fluid in the interior passageways, and wherein for each of the interior passageways:

a lengthwise section of the interior passageway is positioned between the upper and lower walls, the lengthwise section of the interior passageway has a length that extends crosswise to an overall thickness of the base panel, the interior passageway has opposite end sections that are spaced apart from one another, each of the opposite end sections of the interior passageway are sealed closed to at least partially define a compartment configured to collect fluid from the fresh meat, and an opening of the plurality of openings extends through the upper wall, is open to the interior passageway, and is positioned between and spaced apart from each of the sealed closed opposite end sections of the interior passageway.

2. The container according to claim 1, wherein opposite end sections of each of the plurality of interior passageways are sealed closed to at least partially define compartments that are closed except for being open by one or more openings of the plurality of openings.

3. The container according to claim 1, comprising at least one side panel connected to the base panel by a line of disruption and extending at least partially around the interior space of the container, wherein the line of disruption comprises a seam, and the seam seals end sections of at least some of the interior passageways of the plurality of interior passageways.

4. The container according to claim 3, wherein each of the base panel and the at least one side panel is part of an extruded, polymeric sheet.

5. The container according to claim 3, wherein:

none of the plurality of openings are defined in the lower wall of the base panel; and none of the plurality of openings are defined in the at least one side panel.

6. The container according to claim 1, wherein:

the base panel comprises a plurality of web members connected to and extending between the upper and lower walls of the base panel;

the web members are serially spaced apart from one another in a direction extending crosswise to a lengthwise direction of the interior passageways; and at least some openings of the plurality of openings are holes extending through the upper wall which is configured to support fresh meat positioned in the interior space of the container.

7. The container according to claim 6, wherein the lower wall of the base panel defines an exterior surface of the container.

8. The container according to claim 6, wherein an opening of the plurality of openings is a hole that extends into a web member of the plurality of web members.

9. The container according to claim 6, comprising a hole extending through a web member of the plurality of web members so that adjacent interior passageways of the plurality of interior passageways are in fluid communication with one another by way of the hole.

10. The container according to claim 1, wherein for each of the interior passageways, the passageway is hermetically sealed closed except for being open by one or more openings of the plurality of openings extending through the upper wall.

11. The container according to claim 1, wherein for each of the interior passageways, the interior passageway is fully closed except for being upwardly open at one or more openings of the plurality of openings.

12. The container according to claim 1, wherein the lower wall of the base panel defines an exterior surface of the container.

13. The container according to claim 1, wherein:

the base panel has opposite first and second edges; and for each of the interior passageways:

a first of the opposite end sections of the interior passageway is sealed closed by a portion of a first sealed seam foldably connecting the first edge of the base panel to an edge of a first panel extending upwardly from the first edge of the base panel, and a second of the opposite end sections of the interior passageway is sealed closed by a portion of a second sealed seam foldably connecting the second edge of the base panel to an edge of a second panel extending upwardly from the second edge of the base panel.

14. The container according to claim 1, wherein:

the base panel has opposite first and second edges; and for each of the interior passageways:

a first of the opposite end sections of the interior passageway is sealed closed by a portion of a sealed seam in a first panel extending upwardly from the first edge of the base panel, and a second of the opposite end sections of the interior passageway is sealed closed by a portion of a sealed seam in a second panel extending upwardly from the second edge of the base panel.

15. A blank configured for being formed into a container, the blank comprising:

an extruded, polymeric sheet comprising:

a central panel having a periphery, wherein the central panel comprises upper and lower walls that are opposite from one another, a plurality of panels extending outwardly from the periphery of the central panel, a plurality of elongate interior passageways at least partially defined in the central panel; and a plurality of openings extending through the upper wall and respectively open to interior passageways of the plurality of interior passageways, the plurality of openings being configured to allow fluid to flow respectively into the interior passageways, wherein for each of the interior passageways:

a lengthwise section of the interior passageway is positioned between the upper and lower walls of the central panel, the lengthwise section of the interior passageway has a length that extends crosswise to an overall thickness of the central panel, the interior passageway has opposite end sections that are spaced apart from one another, each of the opposite end sections of the interior passageway are sealed closed to at least partially define a compartment configured to collect fluid, and an opening of the plurality of openings extends through the upper wall, is open to the interior passageway, and is positioned between and spaced apart from each of the sealed closed opposite end sections of the interior passageway.

16. The blank according to claim 15, wherein opposite end sections of each of the plurality of interior passageways are sealed closed to at least partially define compartments that are closed except for being open by one or more openings of the plurality of openings.

17. The blank according to claim 15, wherein:

the central panel has opposite first and second edges; and for each of the interior passageways:

a first of the opposite end sections of the interior passageway is sealed closed by a portion of a first sealed seam foldably connecting the first edge of the central panel to an edge of a first panel of the plurality of panels extending outwardly from the first edge of the central panel, and a second of the opposite end sections of the interior passageway is sealed closed by a portion of a second sealed seam foldably connecting the second edge of the central panel to an edge of a second panel of the plurality of panels extending outwardly from the second edge of the central panel.

18. The blank according to claim 15, wherein:

the central panel has opposite first and second edges; and for each of the interior passageways:

a first of the opposite end sections of the interior passageway is sealed closed by sealed seam in a first panel of the plurality of panels extending outwardly from the first edge of the central panel, and a second of the opposite end sections of the interior passageway is sealed closed by a sealed seam in a second panel of the plurality of panels extending outwardly from the second edge of the central panel.

19. The blank according to claim 15, wherein:

the base panel comprises a plurality of web members connected to and extending between the upper and lower walls of the base panel;

the web members are serially spaced apart from one another in a direction extending crosswise to a lengthwise direction of the interior passageways; and an opening of the plurality of openings is a hole that extends into a web member of the plurality of web members.

20. The blank according to claim 15, wherein:

the base panel comprises a plurality of web members connected to and extending between the upper and lower walls of the base panel;

the web members are serially spaced apart from one another in a direction extending crosswise to a lengthwise direction of the interior passageways; and a hole extends through a web member of the plurality of web members so that adjacent interior passageways of the plurality of interior passageways are in fluid communication with one another by way of the hole.

* * * * *